United States Patent [19]

Mattei et al.

[11] Patent Number: 4,601,297

[45] Date of Patent: Jul. 22, 1986

[54] CIGARETTE MANUFACTURING MACHINE WITH AN AUXILIARY TOBACCO FEED UNIT

[75] Inventors: Riccardo Mattei; Bruno Belvederi, both of Bologna, Italy

[73] Assignee: G.D Societa' per Azioni, Bologna, Italy

[21] Appl. No.: 660,959

[22] Filed: Oct. 15, 1984

[30] Foreign Application Priority Data

Oct. 28, 1983 [IT] Italy ..... 3599 A/83

[51] Int. Cl.[4] ..... A24C 5/39

[52] U.S. Cl. ..... 131/109.1; 131/109.3; 131/909

[58] Field of Search ..... 131/909, 109.1, 109.2, 131/109.3

[56] References Cited

U.S. PATENT DOCUMENTS 4,463,767 8/1984 Seragnoli ..... 131/109.1

*Primary Examiner*—V. Millin

*Attorney, Agent, or Firm*—Marshall, O'Toole, Gerstein, Murray & Bicknell

[57] ABSTRACT

Cigarette manufacturing machine with an auxiliary recirculated tobacco feed unit communicating with a downward duct supplying the machine itself. An input conveyor on the auxiliary unit communicates with a tray located between an output on the conveyor itself and the said downward duct, the tray being located in an essentially horizontal plane and being, in cross section, of essentially constant width.

A vibratory unit is connected to the tray for imparting vibration of variable amplitude between points on the same, depending on output signals supplied by means detecting the tobacco level inside the duct.

11 Claims, 4 Drawing Figures

CIGARETTE MANUFACTURING MACHINE WITH AN AUXILIARY TOBACCO FEED UNIT

BACKGROUND OF THE INVENTION

The present invention relates to a cigarette manufacturing machine with an auxiliary tobacco feed unit. Cigarette manufacturing machines are known to be made comprising an input chamber from which shredded tobacco is drawn off by a carding unit and fed to a downward duct. At the bottom end of the latter, provision is made for a supply conveyor for feeding the tobacco towards the bottom end of an upward output duct.

Generally speaking, the said downward duct, which is never without a column of tobacco inside, also acts as a store, the tobacco being drawn off continually from the bottom end of the duct by a toothed roller which feeds it on to the said conveyor.

Known cigarette manufacturing machines of the aforementioned type are usually partly supplied with recirculated tobacco collected downstream from the said upward output duct, by means of skimming devices, and frequently fed straignt back into the said input chamber.

Owing to the small size of the recirculated tobacco particles and, consequently, the difficulty encountered by the carding unit in collecting them, such a solution does not always guarantee a sufficiently uniform level of tobacco inside the downward duct.

This lack of uniformity involves a number of major drawbacks in that it results in an uneven stream of tobacco being formed by the said toothed roller on the said conveyor and, consequently, in uneven distribution of the tobacco along the continuous cigarette rod formed at the output of the said upward duct.

In an attempt to overcome this drawback, recirculated tobacco is known to be fed straight into the downward duct, a number of level detectors being arranged over the width of the latter for detecting the height of the said column at different points. The signals supplied by the said detectors are used for controlling the supply of recirculated tobacco into the said downward duct, so as to ensure the tobacco level is maintained constant over the entire width of the said downward duct.

For example, recirculated tobacco is known to be supplied essentially crosswise in relation to the axis of the said downward duct, by means of a rocking tray designed to turn round an axis parallel with that of the said downward duct. The said tray is provided with an outlet smaller in width than the said duct and designed to shift in response to the said signals, so as to supply recirculated tobacco wherever needed to keep the height of the column even.

As the said outlet describes an arc of a circle as it travels over the width of the said downward duct, using the aforementioned rocking tray entails using downward ducts of relatively ample size crosswise in relation to width.

In other words, the aforementioned rocking tray entails using a large-section downward duct the size of which in view of the duct's additional function, already mentioned, of storing the tobacco, is invariably such as to compress the tobacco inside the duct and impair uniform distribution of the same on the said supply conveyor.

SUMMARY OF THE INVENTION

The aim of the present invention is to provide a cigarette manufacturing machine with a recirculated tobacco feed unit designed to overcome the abovementioned drawback. With this aim in view, the present invention relates to a cigarette manufacturing machine with an auxiliary tobacco feed unit, comprising a downward shredded tobacco supply duct communicating at the top with a main tobacco supply device and having means for detecting the tobacco level inside, the said duct communicating laterally with an outlet on the said auxiliary unit, the latter comprising an input conveyor and a tray located between an output on the said conveyor and the said downward duct, characterized by the fact that the said tray is located in an essentially horizontal plane and, in cross section, is of essentially constant width; a vibratory unit being provided for imparting vibration of varying amplitude between points on the said tray, depending on output signals supplied by the said detecting means.

BRIEF DESCRIPTION OF THE DRAWINGS

A number of non-limiting arrangements of the present invention will now be described with reference to the attached drawings in which.

DETAILED DESCRIPTION OF THE INVENTION

Figure 1:
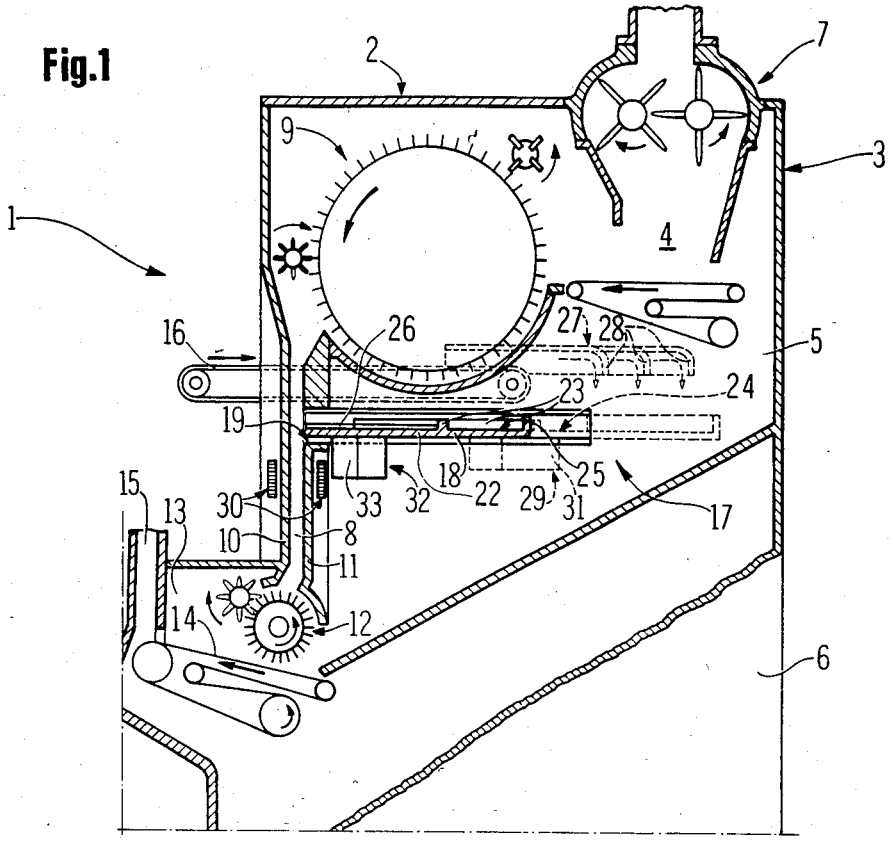
FIG. 1 shows a vertical cross section of a preferred arrangement of a cigarette manufacturing machine according to the present invention.

FIG. 1 shows a cigarette manufacturing machine 1 comprising a distributor 2 designed to form a continuous, uniform flow of tobacco particles from a mass of shredded tobacco.

The component parts on distributor 2 are housed in a vertical casing 3 defining a chamber 4 limited laterally by two vertical walls 5 and 6.

Shredded tobacco is fed into chamber 4 by main supply device 7 and, from there, into downward duct 8 by means of carding unit 9.

Duct 8 has an essentially rectangular cross section and is limited widthwise by two essentially vertical walls 10 and 11 perpendicular with walls 5 and 6.

The bottom end of duct 8 comes out over a toothed output unit 12 designed to draw tobacco out of duct 8 itself.

Unit 12 feeds the tobacco, in the form of separate particles, into chamber 13 the bottom of which is defined by collecting belt 14 moving, in FIG. 1, upwards from right to left.

The output end of belt 14 is located next to the bottom end of upward duct 15 the top end (not shown) of which communicates with a rod-forming unit (not shown).

As is generally known, on the said rod-forming unit, the tobacco particles cling to the bottom face of at least one suction conveyor belt (not shown) so as to form a layer of tobacco (not shown) the thickness of which is evened out by a skimming device (not shown).

Figure 2:
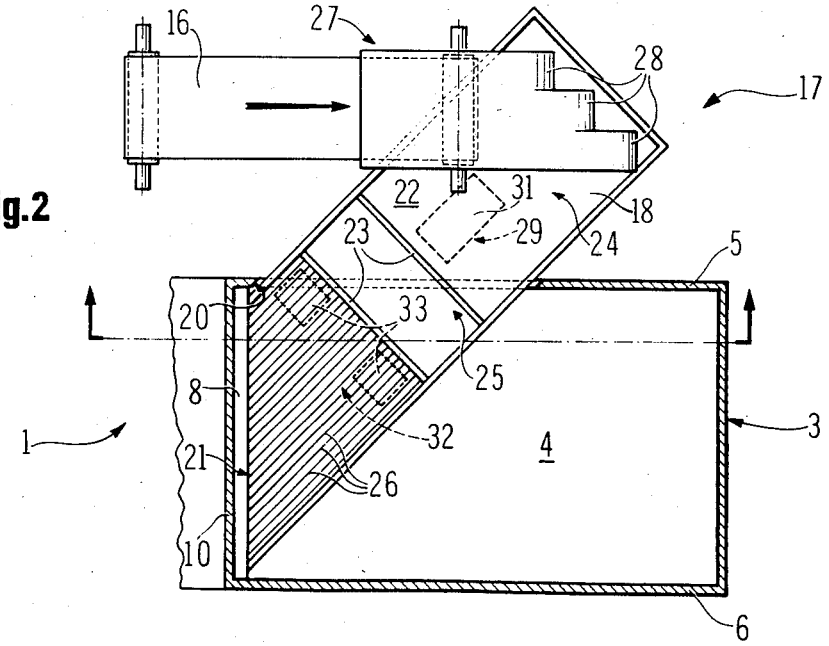
FIG. 2 shows a plan view of a detail in FIG. 1.

The tobacco removed by the said skimming device is fed, by conveyors not shown, on to an input conveyor belt 16 located immediately below chamber 4 and forming part of an auxiliary feed unit 17 designed to recirculate the tobacco removed by the said skimming device. Besides conveyor 16, auxiliary feed unit 17 also comprises an essentially horizontal tray 18 the input end of which is located underneath the output end of conveyor 16, and the output end of which communicates with a mid point on duct 8 through a side opening 19 in wall 11 of the same. As shown in FIG. 2, conveyor 16 extends outwards of wall 5, its width being essentially constant and smaller than that of tray 18. The latter is slanted in relation to both conveyor 16 and wall 5 and extends through an opening 20 in the latter as far as opening 19 in wall 11. Tray 18 is essentially constant in width and arranged with its input end underneath the output end of conveyor 16. At its output end, tray 18 is limited by edge 21 slanting in relation to the longitudinal axis of tray 18 so that its length is essentially equal to the width of opening 19 and, consequently, of duct 8.

Tray 18 presents a bottom wall 22 an input portion of which is provided with two crosswise ribs 23 defining two tanks 24 and 25 arranged one after the other in the tobacco feed direction along tray 18. An output portion of wall 22, on the other hand, is provided with a number of longitudinal ribs 26 designed to guide the tobacco as it is fed towards duct 8.

Figure 3:
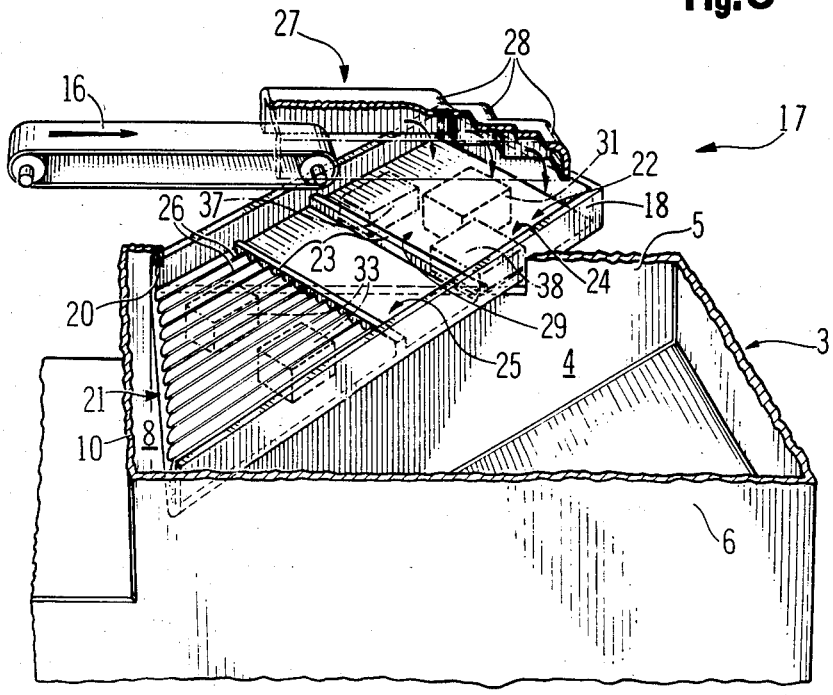
FIG. 3 shows a partially-sectioned side elevation of the FIG. 2 detail.

As shown in FIG. 3, conveyor 16 slants upward in the tobacco feed direction and is designed to hurl the tobacco inside tank 24 and to distribute it essentially evenly over the width of tray 18. This is achieved by means of a distributor 27 comprising a number of curved pieces 28 turned downwards towards tank 24, aligned with the axis of conveyor 16 and each designed to intercept a respective longitudinal portion of the tobacco stream carried on conveyor 16, and to divert it on to a respective portion of tank 24. In more detail, pieces 28 differ in length and are arranged with their free curved ends aligned along a line essentially perpendicular with the longitudinal axis of tray 18.

Bottom wall 22 on tray 18 is connected to a vibratory unit 29 designed to vibrate tray 18 in such a manner as to feed the tobacco towards duct 8.

Unit 29 is controlled by a detecting unit 30 comprising a number of photocells arranged horizontally along walls 10 and 11 and designed to detect the height of the tobacco column formed inside duct 8 and to affect operation of unit 29 in such a manner as to even out any difference in level detected on the said column over the width of duct 8.

In the FIG. 1, arrangement, unit 29 comprises a vibratory device or vibration generator 31 and a dampening device 32 consisting of at least two magnetic field generators 33 arranged over the width of tray 18.

The magnetic fields generated by generators 33 are linked to wall 22 and of varying intensity controlled by detecting unit 30, so as to determine, on tray 18, a stream of tobacco the speed of which varies, according to a given law, over the width of tray 18, in such a manner as to even out the level of the column inside duct 8.

Figure 4:
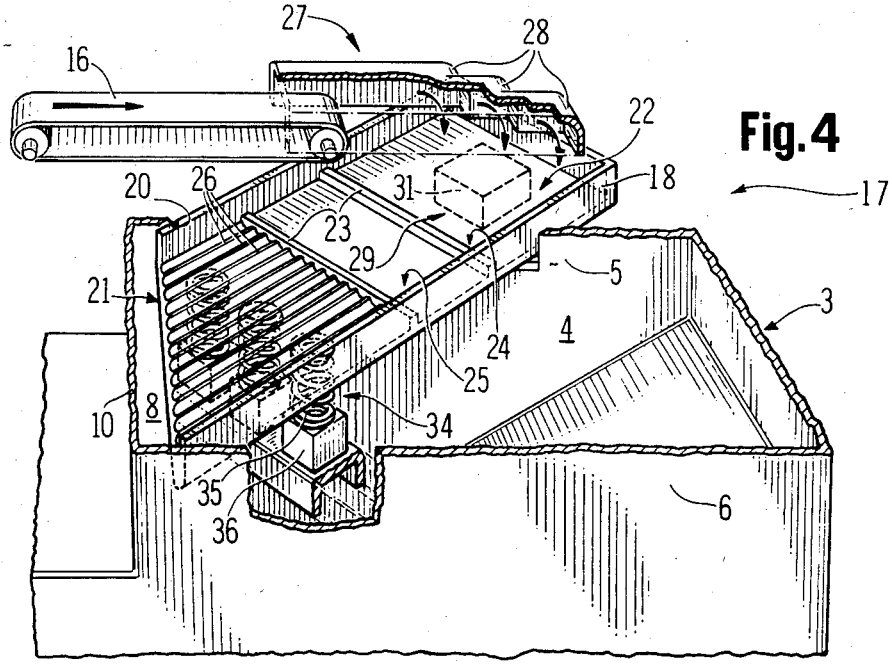
FIG. 4 shows a partially-sectioned elevation of a variation of a detail in FIG. 1.

In the FIG. 4 variation, the same result is achieved using a dampening device 34 comprising at least two springs 35 (three in the example shown in FIG. 4) connected to wall 22 on tray 18 and arranged over the width of the same. The tension on each spring 35 may be adjusted selectively by means of respective actuator 36 controlled by detecting unit 30.

In the variation shown by the dotted line in FIG. 3, in place of generator 31, unit 29 comprises two vibratory devices or vibration generators, 37 and 38, the vibration amplitude and/or frequency of which may be controlled by detecting unit 30.

In connection with unit 29, it should be pointed out that sloping edge 21 and distributor 28 enable the tobacco to travel along tray 18 parallel with the axis of the latter at all times, despite the fact that tray 18 is wider than conveyor 16 and norrower than duct 8.

Constant longitudinal tobacco feed prevents preferential tobacco feed routes from being formed along tray 18, the existence of which would drastically impair the efficiency of unit 29 in controlling the level of the tobacco column inside duct 8.

We claim:

1. A cigarette manufacturing machine comprising:

a main tobacco supply unit:

a shredded tobacco supply duct extending downwardly from said main tobacco supply unit;

an auxiliary tobacco supply unit having an outlet communicating with an intermediate point of said duct, said auxiliary unit comprising an input conveyor and a tray, said tray being arranged between an outlet of said input conveyor and said duct, and having a bottom wall which extends in a substantially horizontal plane, and is substantially constant in width;

a vibratory unit being coupled to said tray to impart thereto a vibration the amplitude of which may be varied from point to point across said bottom wall;

and level detecting means sensitive to the level of the tobacco within said duct, said level detecting means controlling the amplitude of the vibration imparted by said vibratory unit to any point of said bottom wall so as to even out any difference in level detected by said detecting means over the width of said duct.

2. A machine as claimed in claim 1, wherein said tray is smaller in width than said duct and has an output end edge slanting relative to a longitudinal axis of the tray itself; said output end edge being substantially equal, in length, to the width of said duct.

3. A machine as claimed in claim 1, wherein said vibratory unit comprises at least two separate vibratory devices coupled to said bottom wall and arranged over the width thereof; said vibratory devices being selectively controlled by said detecting means.

4. A machine as claimed in claim 1, wherein said vibratory unit comprises a vibratory device coupled to said bottom wall, and vibration dampening means coupled to predetermined points on said bottom wall; said vibration dampening means having a variable damping capacity and being controlled by said detecting means.

5. A machine as claimed in claim 1, wherein said vibratory unit comprises vibration dampening means coupled to predetermined points on said bottom wall; said vibration dampening means having a variable damping capacity and being controlled by said detecting means.

6. A machine as claimed in claim 4, wherein said dampening means comprise at least two adjustable magnetic field generators which are magnetically coupled to said bottom wall and are arranged over the width thereof.

7. A machine as claimed in claim 4, wherein said dampening means comprises at least two adjustable-tension springs coupled to said bottom wall and arranged over the width thereof.

8. A machine as claimed in claim 1, wherein said bottom wall is provided with upper transverse ribs defining, on said bottom wall, at least two tanks arranged one after the other in the tobacco feed direction.

9. A machine as claimed in claim 1, wherein said bottom wall comprises an output portion having a plurality of longitudinal upper ribs.

10. A machine as claimed in claim 1, wherein said input conveyor is smaller in width than said tray, has a longitudinal axis which is inclined relative to a longitudinal axis of said tray, and has an output end which is arranged over an input end of said tray; distributing means being arranged over said output end of said conveyor for distributing the tobacco advanced by said conveyor over the entire width of said tray in a substantially even manner.

11. A machine as claimed in claim 10, wherein said distributing means comprise a number of curved members of different lengths arranged over the width of said conveyor.

* * * * *